US009957725B2

(12) United States Patent
Maurer

(10) Patent No.: US 9,957,725 B2
(45) Date of Patent: May 1, 2018

(54) MULTI-PURPOSE CLEANING TROWEL

(71) Applicant: Creative Products International, Inc., Holland, MI (US)

(72) Inventor: David A. Maurer, Fort Collins, CO (US)

(73) Assignee: CREATIVE PRODUCTS INTERNATIONAL, INC., Holland, MI (US)

( * ) Notice: Subject to any disclaimer, the term of this patent is extended or adjusted under 35 U.S.C. 154(b) by 542 days.

(21) Appl. No.: 14/177,991

(22) Filed: Feb. 11, 2014

(65) Prior Publication Data

US 2015/0225968 A1 Aug. 13, 2015

(51) Int. Cl.
*E04F 21/16* (2006.01)

(52) U.S. Cl.
CPC ..... *E04F 21/161* (2013.01); *E04F 21/163* (2013.01)

(58) Field of Classification Search
None
See application file for complete search history.

(56) References Cited

U.S. PATENT DOCUMENTS 893,275 A 7/1908 Stoddard
1,575,318 A * 3/1926 Cowan ..... E04F 21/06 15/105
2,147,458 A * 2/1939 Rohland ..... A45D 7/04 132/212
2,691,185 A * 10/1954 Jones ..... A47L 13/48 15/227
2,730,748 A * 1/1956 Smyth ..... A47L 13/252 15/229.8
3,916,472 A * 11/1975 Carder ..... B05C 17/10 15/235.6
4,240,176 A * 12/1980 Farmer ..... A47L 1/06 15/117
4,893,369 A * 1/1990 Johnson ..... A47L 13/146 15/119.2
5,012,544 A 5/1991 Verry
5,530,984 A 7/1996 Walker
(Continued)

FOREIGN PATENT DOCUMENTS

DE 9308947 U1 8/1993

OTHER PUBLICATIONS

FilmopUsa. FilmopUsa Video Floor dusting system 102012. Youtube. Nov. 21, 2012. 16-20,22 [retrieved Feb. 27, 2015). Retrieved from the internet: <URL: http://www.youtube.comlwatch?v=IAr_UnxO_m4>.

(Continued)

*Primary Examiner* — Joseph J Hail
*Assistant Examiner* — Brian Keller
(74) *Attorney, Agent, or Firm* — Levenfeld Pearlstein, LLC

(57) ABSTRACT

A multipurpose cleaning trowel is provided. The cleaning trowel includes a base having a first side, a second side, a flexible section, a blade section, and a mounting section positioned between the flexible section and the blade section. The cleaning trowel further includes a handling device removably secured to the first side of the base at the mounting section and a cleaning pad receiving region. A cleaning pad is removably secured to the base. The handling device is interchangeable between a fixed handle and a swivel base.

16 Claims, 7 Drawing Sheets

(56) References Cited

U.S. PATENT DOCUMENTS

| | | | | |
|---|---|---|---|---|
| 6,523,213 | B1 * | 2/2003 | Post | A47L 1/15 15/104.94 |
| 7,115,172 | B1 * | 10/2006 | Teodorovich | E04F 21/16 134/42 |
| 7,384,328 | B2 * | 6/2008 | Panfili | B24B 23/00 451/344 |
| 8,201,300 | B2 * | 6/2012 | Cutler | A47L 13/11 15/143.1 |
| 2004/0250365 | A1 * | 12/2004 | Anderson | A46B 15/0081 15/111 |
| 2005/0166863 | A1 * | 8/2005 | Park, III | A01K 13/002 119/625 |
| 2006/0085935 | A1 | 4/2006 | White, II | |
| 2007/0011835 | A1 * | 1/2007 | Hubbard | A46B 15/0002 15/105 |
| 2007/0025932 | A1 * | 2/2007 | Ponce | A61K 8/33 424/59 |
| 2010/0027246 | A1 | 2/2010 | Petersen | |
| 2010/0088839 | A1 | 4/2010 | Georgieff | |
| 2012/0227197 | A1 | 9/2012 | Fleischer | |
| 2014/0013527 | A1 | 1/2014 | Molinet et al. | |

OTHER PUBLICATIONS

International Search Report for PCT/US2014/072119 dated Apr. 16, 2015.

International Preliminary Report on Patentability issued by International Bureau of WIPO in connection with PCT/US2014/072119 dated Aug. 25, 2016.

Supplementary European Search Report issued by ISA/EPO in connection with EP14882414 dated Feb. 6, 2018.

* cited by examiner

MULTI-PURPOSE CLEANING TROWEL

BACKGROUND

The following description relates to a multi-purpose cleaning trowel, and in particular, to a multi-purpose cleaning trowel that may be adapted for use in multiple environments.

Conventional cleaning devices for cleaning floors, counters, tables or other surfaces may include a replaceable or reusable pad secured to head of the cleaning device. Traditionally, the pad is secured to the head with a releasable fastener, such as VELCRO® or other hook and loop fastener. However, in conventional cleaning devices, the releasable fastener fastening the pad to the head may lose strength after repeated use. As a result, the pad may become loose, or even removed, from the head during use.

In other scenarios, a surface to be cleaned may include dried or hardened particles adhered thereon. Conventional cleaning devices may be useful in moving or collecting loose particles. However, the pad may pass over the dried or hardened particles leaving these particles behind to be cleaned by other means.

Further, conventional cleaning devices may include an elongated handle so that a user may, for example, use the cleaning device similar to a mop or broom on a floor. The elongated handle allows to the user to more easily reach a surface to be cleaned with the pad. However, the amount of force applied to the surface via the pad may be limited by the elongated handle. In addition, the elongated handle may make the cleaning device difficult or awkward to use on surfaces that are easily reached by user, such as a counter or table.

Further still, with conventional cleaning devices, it may be difficult for a user to identify areas of a surface that need to be cleaned if lighting is poor. For example, lighting may be poor around furniture, in corners, or other shadowy areas. In addition, where areas to be cleaned may be identified by a user, these areas are often limited to areas where debris, particles or other contaminants are visible under ordinary viewing conditions. It may be difficult to identify areas on surfaces where germs or other contaminants are located.

Accordingly, it is desirable to provide a multi-purpose cleaning trowel that is adapted for use in multiple environments that addresses the drawbacks described above.

SUMMARY

According to one embodiment, there is provided cleaning trowel comprising a base having a first side, a second side, a flexible section, a blade section, and a mounting section positioned between the flexible section and the blade section. The cleaning trowel further includes a handling device on the first side of the base at the mounting section, and a cleaning pad receiving region to the base.

Other objects, features, and advantages of the disclosure will be apparent from the following description, taken in conjunction with the accompanying sheets of drawings, wherein like numerals refer to like parts, elements, components, steps, and processes.

DETAILED DESCRIPTION

Figure 1:
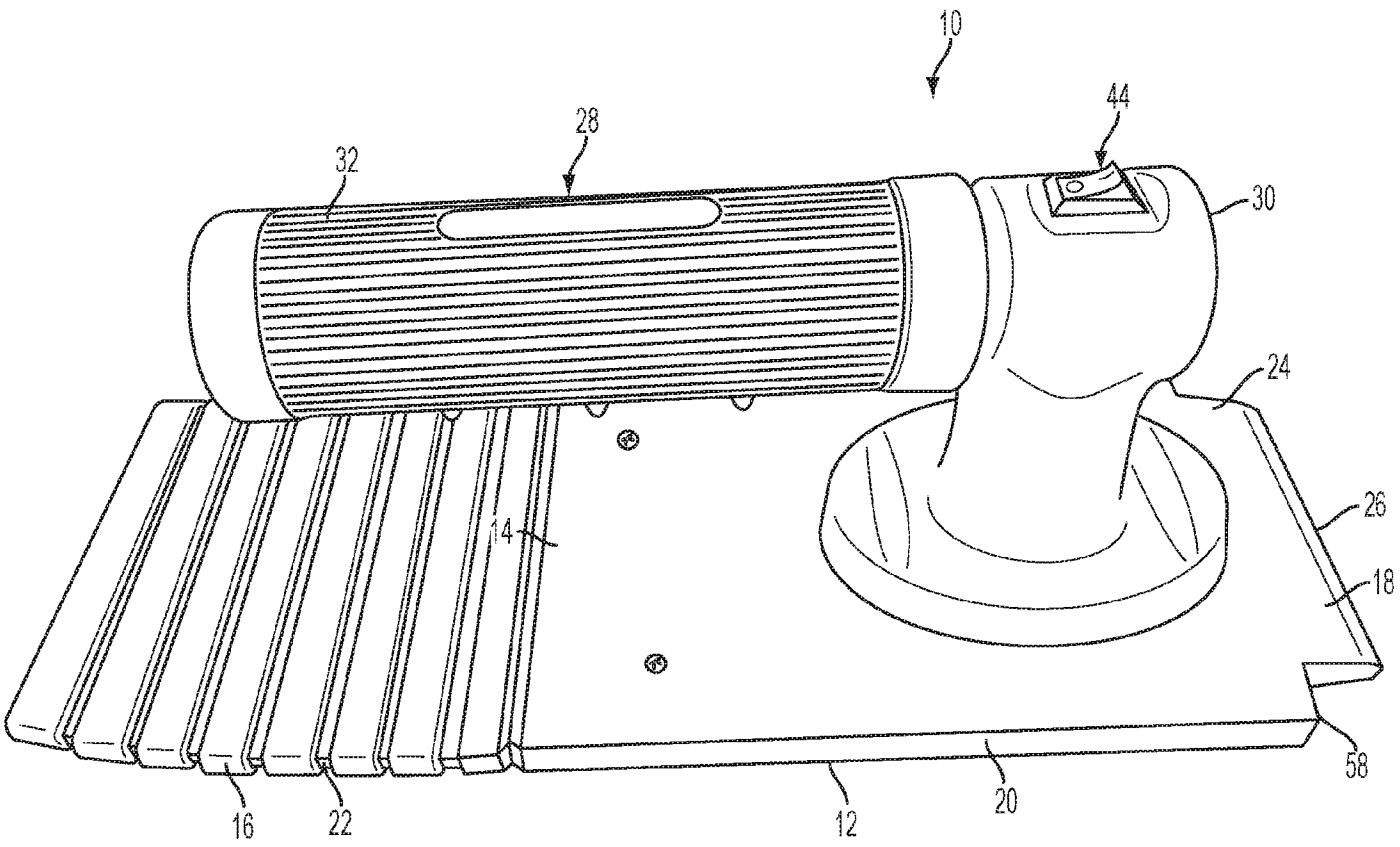
FIG. 1 is a perspective view of a multi-purpose cleaning trowel according to an embodiment.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

FIG. 1 is a perspective view of a multi-purpose cleaning trowel 10 according to an embodiment described herein. The trowel 10 includes a base 12 having a first side 14 configured to face away from a surface to be cleaned during use of the trowel 10. In some embodiments, the first side 14 may be an upper surface of the base 12. The base 12 also includes a flexible section 16, a blade section 18 and a mounting section 20 extending between the flexible section 16 and the blade section 18, along a length of the base 12. In one embodiment, the base may be substantially rectangular and the first side 14 maybe substantially planar.

The flexible section 16 extends along a portion of the length of the base 12. In one embodiment, the flexible section 16 includes one or more grooves 22. The grooves 22 may be areas of reduced thickness of the flexible section 16 relative to immediately adjacent portions of the flexible section 16. The one or more grooves may extend transversely across the flexible section 16. The one or more grooves 22 may allow for flexing of the flexible section 16 between a flexed condition and an unflexed condition. In one embodiment, the flexible section 16 is made of a different material than the rest of the base 12. The flexible section 16 may be made from, for example, a plastic, polymer or other similar material, preferably having elastic properties. The flexible section 16 may be secured directly or indirectly to mounting section 20 by conventional fastening methods. Alternately, the flexible section 16 may be co-molded, over-molded or the like, with the mounting section 20. The flexible section 16 may also be a different color than the rest of the base 12. In addition, the flexible section 16 may have either transparent or opaque properties. The color and/or light transmitting properties of the flexible section 16 may be a result of the material from which the flexible section 16 is made, or may be added during or after a manufacturing process.

The blade section 18 may extend from an opposite end of the mounting section 20 than the flexible section 16. The blade section 18 includes a proximate end 24 nearest the mounting section 20 and a free, distal end 26. A thickness of the blade section 18 may decrease along a direction from the proximate end 24 to the distal end 26. Accordingly, in use, the blade section 18 may be used to chip or remove hardened objects from a cleaning surface. In one embodiment, the blade section 18 has a width that is less than a width of the mounting section 20. In addition, the blade section 18 may be formed of the same material as the mounting section 20. For example, the blade section 18 may be made from a hard plastic, compressed rubber or similar material that is resistant to chipping and suitable for removal of hardened debris or contaminants from a surface to be cleaned. In one embodiment, the blade section 18 is formed integrally with the mounting section 20 as a one-piece, monolithic construction. However, the present disclosure is not limited to this embodiment. For example, the blade section 18 may be separately attached.

The trowel 10 also includes a handling device 28. In an embodiment, the handling device 28 is removably secured to the mounting section 20 of the base 12. The handling device 28 may be removably secured to the mounting section 20, for example, with removable fasteners, such a bolts or screws, by snap, interference or friction fit, or other similar releasable fastening devices. Alternately, the handling device 28 may be formed integral with or permanently mounted to the mounting section 20.

In one embodiment, the handling device 28 is a fixed handle 28. The fixed handle 28 includes a handle base 30 and a gripping portion 32. In one embodiment, the handle base 30 is in contact with the first side 14 of the mounting section 20 and is removably secured thereto. The gripping portion 32 extends from the handle base 30. In one embodiment, the gripping portion 32 extends from the handle base 30 at an angle, for example, ninety degrees. Accordingly, in this example, the gripping portion 32 is spaced from the base 12 by the handle base 30, and may extend substantially parallel to the base 12. It is understood that the present disclosure is not limited to this example and other configurations are considered. For example, the gripping portion 32 may extend from the handle base 30 at a non-right angle. The gripping portion 32 may include ergonomic features our contours, or may be otherwise ergonomically shaped.

Figure 2:
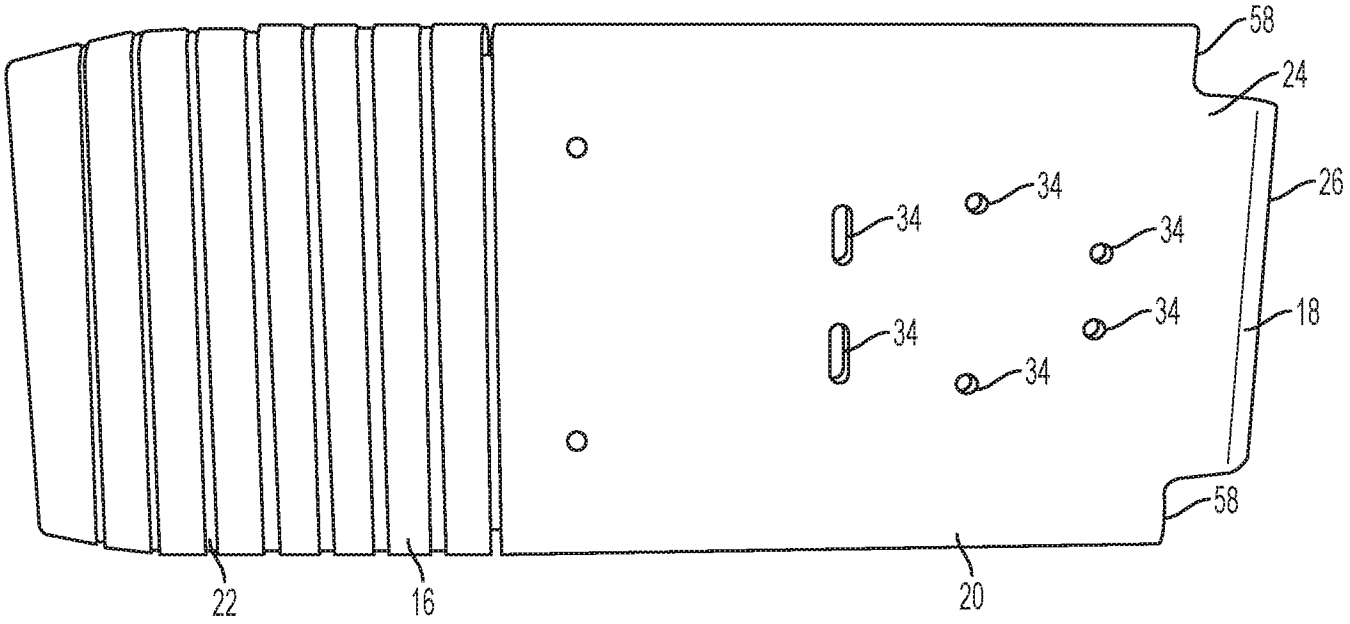
FIG. 2 is a top plan view of an example of a base of the multi-purpose cleaning trowel of FIG. 1.
Figure 3:
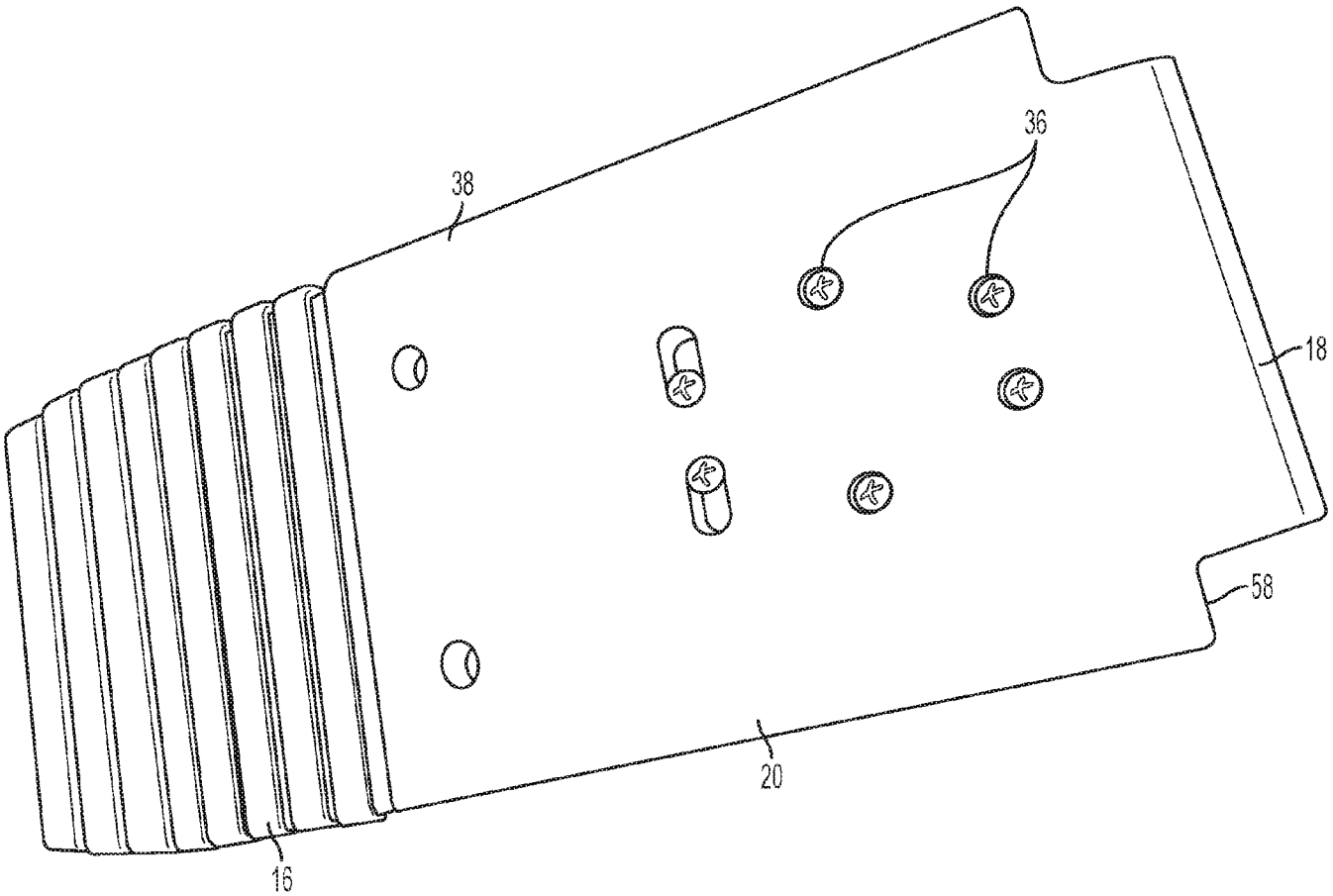
FIG. 3 is a bottom view of the multi-purpose cleaning trowel of FIG. 1.

FIG. 2 is a top plan view of an example of the base 12 of the multi-purpose cleaning trowel 10. FIG. 3 is a bottom view of the multi-purpose cleaning trowel 10. As described above, the handling device 28 is removably secured to the mounting section 20. In one example, and with reference to FIGS. 2 and 3, the mounting section 20 includes at least one fastening hole 34 configured to receive a fastener 36 to be received through the mounting section 20 and at least partially within the handling device 28 to removably secure the handling device 28 to the mounting section. It is understood that the present disclosure is not limited to the example and other configurations, for example, those described above, are envisioned for removably securing the handling device 28 to the mounting section 20.

Referring to FIG. 3, the base 12 includes a second side 38 configured to face the surface to be cleaned. That is, the second side 38 may face in an opposite direction from the first side 14. In one embodiment, as shown in FIG. 2, the fastening holes 34 may extend completely through the mounting section 20, from the first side 14 to the second side 38. The second side 38 may be substantially planar.

Figure 4:
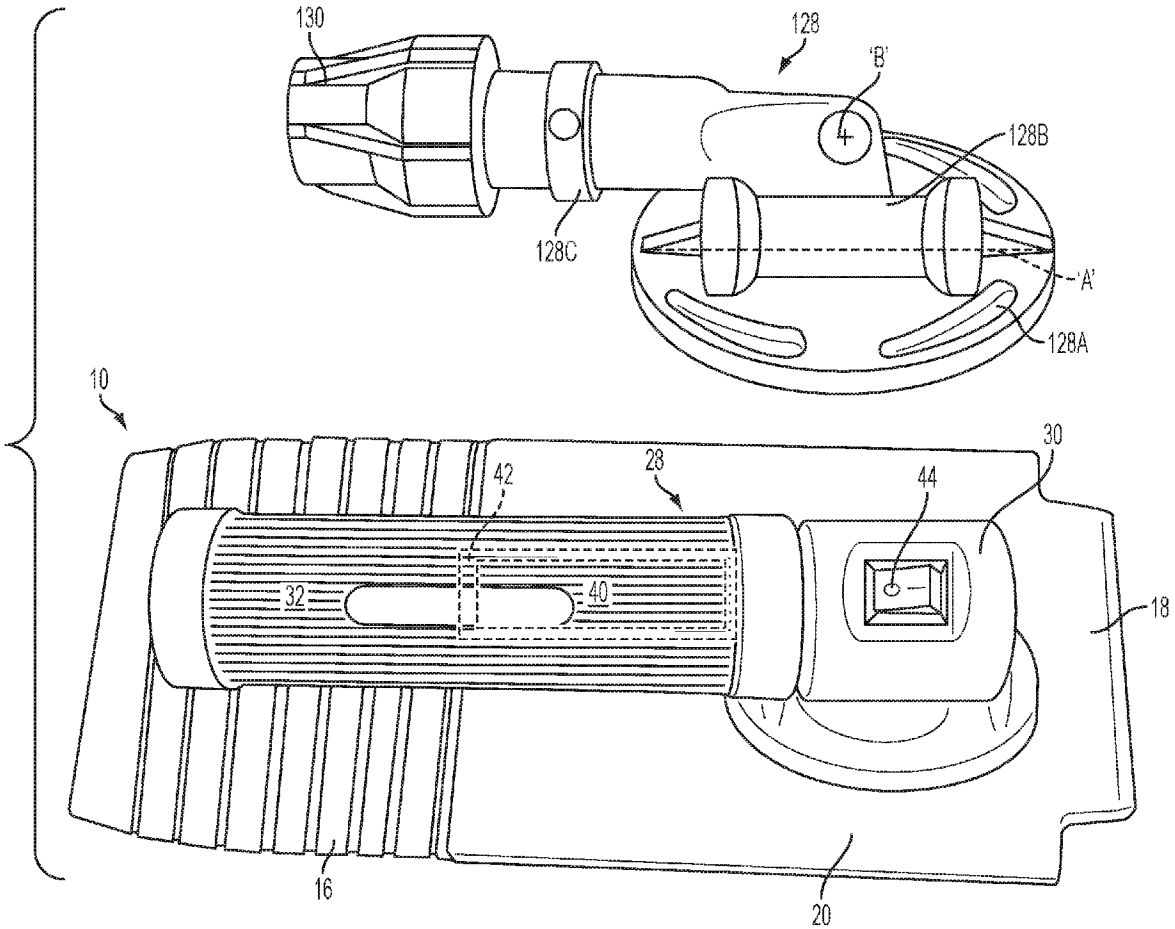
FIG. 4 is a perspective view of the multi-purpose cleaning trowel of FIG. 1 with examples of interchangeable handling devices.

FIG. 4 is a perspective view of the trowel 10 having interchangeable handling devices 28, 128 according to an embodiment. That is, the trowel 10 may be used with the handling device 28 formed as the fixed handle 28 as described in the examples above. The handling device 28 may be alternatively formed as a swivel base 128 that is removably secured to the mounting section 20. That is, depending on a particular desired use of the trowel 10, one of the fixed handle 28 and the swivel base 128 may be removably secured to the mounting section 20, and the other of the fixed handle 28 and the swivel base 128 may be removed from the mounting section 20.

In one embodiment, the swivel base 128 is formed in a two-axis, gimbal-like manner, and may include a first swivel part 128A, a second swivel part 128B and a third swivel part 128C. The first swivel part 128A may be removably secured to the mounting section 20 in the same fashion as described above with respect to the fixed handle 28. For example, as shown in FIGS. 2 and 3, fasteners 36 (FIG. 3) may be received through the fastening holes 34 of the mounting section and received in the first swivel part 128A to secure the swivel base 128 to the trowel base 12. It is understood that the present disclosure is not limited to this configuration.

The second swivel part 128B may be rotationally coupled to the first swivel part 128A. The second swivel part 128B may be rotatable on a first axis 'A' in a first and a second direction. The third swivel part 128C may be rotationally coupled to the second swivel part 128B, and rotate about a second axis 'B', extending in a different direction than the first axis 'A'. Accordingly, the third swivel part 128C may rotate in a third direction and a fourth direction. The third swivel part 128C may also include a connector 130 on one end that is configured for connection to an elongated handle (not shown). The connector 130 may be, for example, internally threaded, and may be configured to receive a corresponding externally threaded elongated handle (not shown). It is understood that this example is non-limiting, and that other configurations of the connector are envisioned as well.

Figure 5:
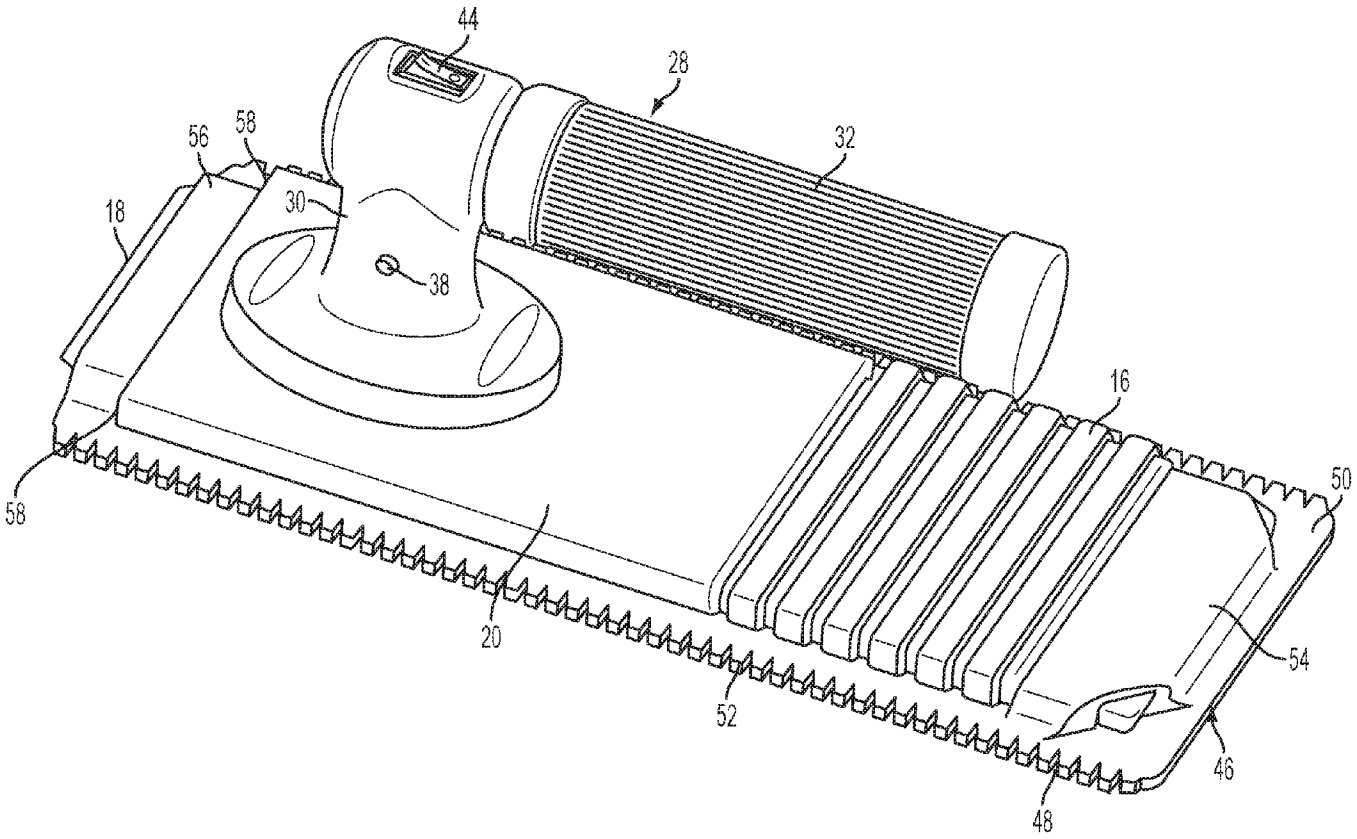
FIG. 5 is a perspective illustration of the multi-purpose cleaning trowel of FIG. 1 with an example of a cleaning pad secured thereto.

FIG. 5 is another perspective view of the trowel 10. In this embodiment, the trowel may include at least one light 38 in the handling device 28, according to one embodiment. The at least one light 38 may include a "white" light configured to illuminate dark areas, for example, isolated corners or surfaces, or under furniture or appliances. The at least one light 38 may additionally, or alternatively, include a "black" light (e.g., ultraviolet light source), to expose germs or other debris or contaminants not visible under non-enhanced lighting conditions. The at least one light 38 may be a light emitting diode (LED). It is understood that the at least one light 38 may be included in the handling devices shown in FIGS. 1 and 4 as well.

Referring again to FIG. 4, the fixed handle 28 may include a power source 40 operably connected to the at least one light 38 to supply power thereto. For example, the gripping portion may include a compartment 42 to house the power source 40. In one embodiment, the power source may be one or more batteries. The gripping portion 32 may be detached from the handle base 30, for example, by a threaded connection, to provide access to the compartment 42 within the gripping portion 32 and at least one battery 40 may be inserted or removed from the compartment 42. Alternatively, the gripping portion 32 may include a door or plug providing access to the compartment 42 and the one or more batteries 40. The handling device 28 may also include a switch 44 to operate the at least one light by controller power supplied to that at least one light. The switch 44 may be of known configuration, such as a rocker switch or push-button switch. It is contemplated that the lighted handle embodiment of the housing is sealed to prevent the incursion of water or other liquids. Other similar switches are envisioned as well.

It is understood that other power sources and compartments are envisioned, and the present disclosure is not limited to the examples above. Further, it is understood that although the above examples are described with reference to the fixed handle 28, the features above may be included as part of the swivel base 128 as well.

Figure 6:
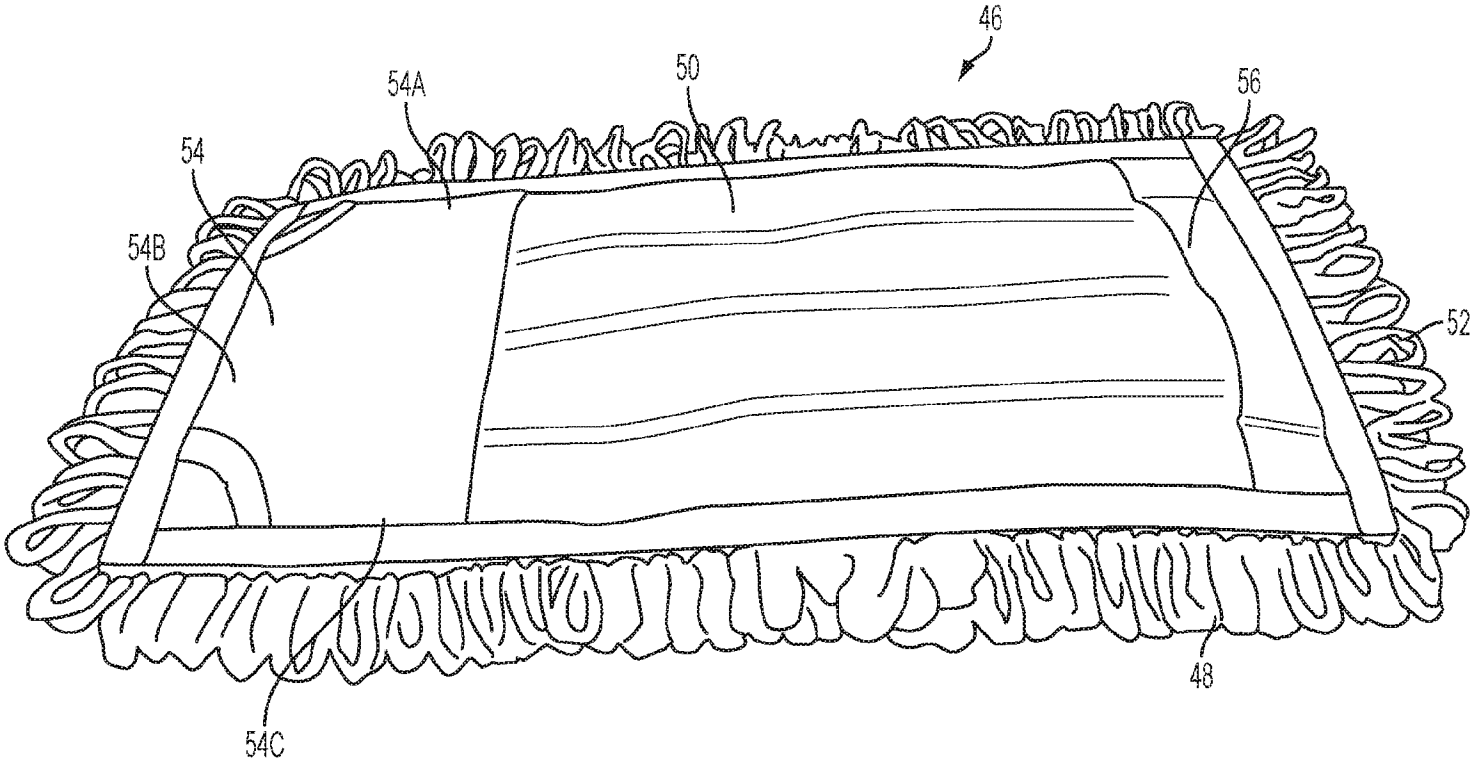
FIG. 6 illustrates a cleaning pad according to one embodiment.

With further reference to FIG. 5, the cleaning trowel 10 may include a cleaning pad 46 removably secured to thereto. In addition, FIG. 6 shows the cleaning pad 46 separated from the trowel 10. Referring to FIGS. 5 and 6, in one embodiment, the cleaning pad 46 is secured to the base 12. The cleaning pad 46 includes a cleaning side 48 and an attachment side 50. The cleaning side 48 is configured to contact a surface to be cleaned. The cleaning side 48 includes a plurality of fabric or fiber cleaning loops 52. Similar materials may be used for the cleaning loops 52 as well. For example, the loops 52 may be formed from a microfiber rope. The cleaning loops 52 are configured to trap and collect debris or other contaminants from the surface to be cleaned. In one configuration, the rope is secured between adjacent cleaning loops 52 to the attachment side 50. In such a configuration, the loops of the ropes extend outwardly from the attachment side 50 where they are secured to the attachment side 50. In essence, the ropes depend from attachment side 50 from the location at which they are secured to the attachment side 50. This configuration provides channels (not shown) along the cleaning surface where the ropes are secured to the attachment side 50.

The attachment side 50 may include a first attachment loop 54 and a second attachment loop 56. The first attachment loop 54 and the second attachment loop 56 may be stitched or otherwise attached to a fabric forming the attachment side 50. In one embodiment, the first attachment loop 54 is configured to receive the flexible section 16 of the base 12. The first attachment loop 54 may be formed generally as a pocket having three closed sides 54A, 54B, 54C so that the flexible section 16 may be positioned therein. The pocket configuration may limit relative movement between the cleaning pad 46 and the base 12.

The second attachment loop 56 is configured to receive the blade section 18. In some embodiments, a portion of the mounting section 20 may be received in the second attachment loop 56. The second attachment loop 56 may be formed as a strip material that is stitched or otherwise fastened at or near opposing lateral sides of the attachment side 50. Accordingly, the second attachment loop 56 may define an opening through which the blade section 18 is received. In some embodiments, the second attachment loop 56 is attached to the attachment side at a distance spaced inwardly from the lateral sides of the cleaning pad. Accordingly, the attached or secured portions of the second attachment loop may abut a shoulder 58 formed at the intersection of the blade section 18 and the mounting section 20. The shoulder may be formed by a reduce width of the blade section 18.

In use, the cleaning pad 46 may be secured onto the base by inserting the flexible section 16 of the base 12 into the first attachment loop 54 and the blade section 18 into the second attachment loop 56. The flexible section 16 may flex to allow to the second attachment loop 56 to extend beyond the blade section 18. The flexible section 16 may then be returned to an unflexed condition so that the second attachment loop 56 extends over the blade section 18, thereby removably securing the cleaning pad 46 to the trowel 10.

The cleaning pad 46 may be removed from the trowel 10 by flexing the flexible section 16 so that the second attachment loop 56 may be removed from over the blade section 18. The first attachment loop 54 may then be removed from over the flexible section 16. Alternatively, or in addition, the cleaning pad may be elastically deformable such that the second attachment loop 56 may be stretched over the blade section 18. It is understood that the process to securing and removing the cleaning pad 46 from the base may vary and is not limited to the examples described above. For example, the second attachment loop 56 may be fit over the blade section 18 and the flexible section 16 may be flexed so that the first attachment loop 54 may fit over an end of the flexible section 16. In the examples above, the cleaning pad 46 may be selectively removed from the base 12 and washed or replaced with a new cleaning pad 46 after use.

In addition, the trowel 10 may be used with interchangeable handle devices 28, 128. For example, the fixed handle 28 may be secured to the base 12. A user may grip the gripping portion 32 to manipulate the trowel 10. This configuration may be useful in situations where, for example, additional leverage is needed to clean or scrub a surface. This configuration may also be useful for cleaning surfaces that are easily comfortably reached by the user, for example, counter tops and tables. The fixed handle 28 may be selectively removed by removal of the fasteners 36 and interchangeably replaced with the swivel base 128. The swivel base 128 may be secured to the mounting section 20 of the base 12 with the fasteners 36. The swivel base 128 may be removably secured to the base at one end (i.e., at the first swivel part 128A) and connected to an elongated handle and another end (i.e., the third swivel part 128B). In one example, the swivel base 128 is rotatable about two axes, and thus, is rotatable in four directions. However, the present disclosure is not limited to this example. For example, the swivel base 128 may include a ball joint allowing for movement in additional directions. With the elongated handle connected to the swivel base 128, the trowel 10 may be manipulated to for use on surfaces that are difficult or uncomfortable for a user to reach. For example, a user may clean a floor or ceiling by using the swivel base 128 with the elongated handle.

In addition, as described above, the trowel may include at least one light 38. The at least one light may include at least one "white" light to illuminate dark or shadowed spaces, and/or at least one black light to detect germs or other contaminants not otherwise ordinarily visible. Accordingly, a user may identify areas on a surface to be cleaned. The at least one light may be operated by a switch 44 on the handling device 28, 128. The at least one light 38 may be powered by the power source 40, such as a battery.

Figure 7:
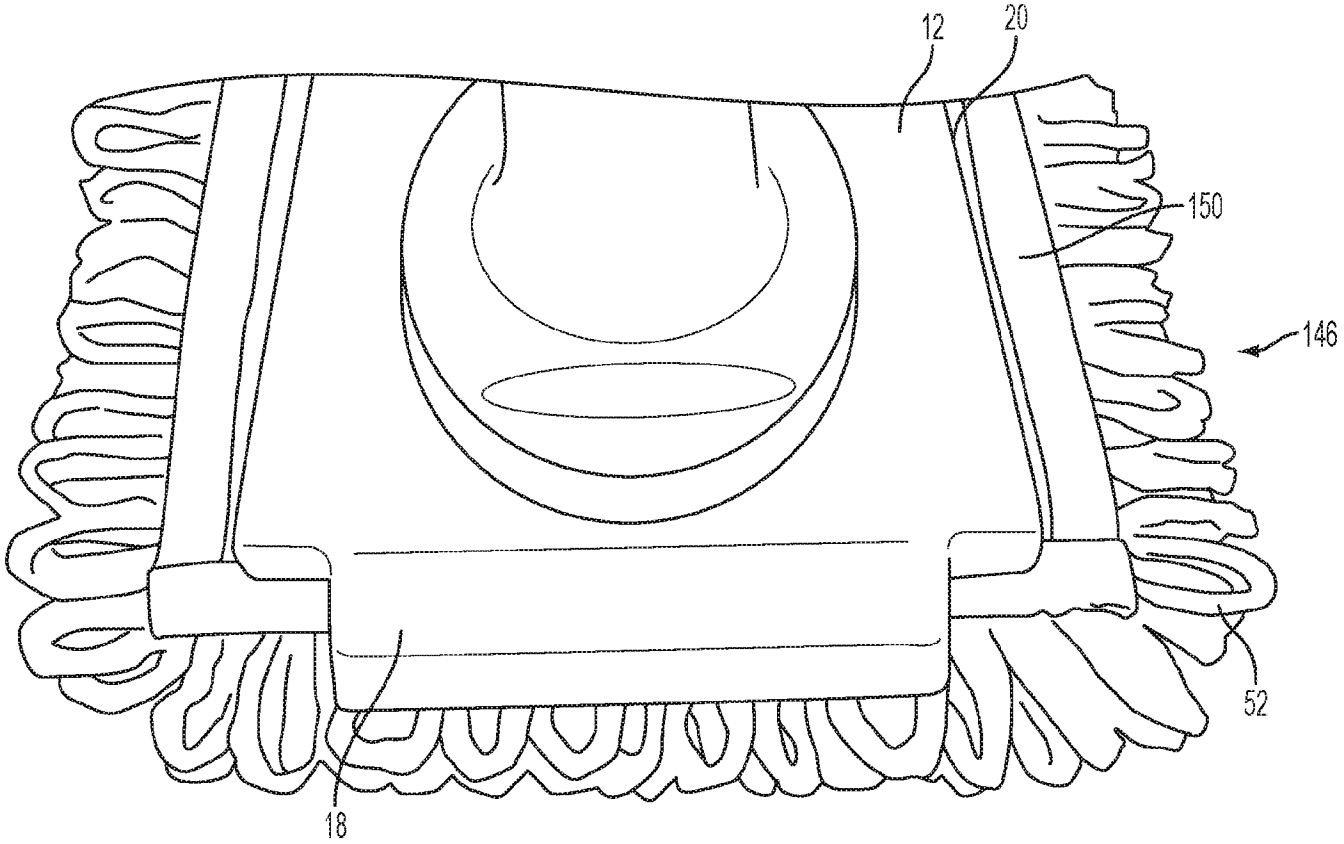
FIG. 7 illustrates an alternative embodiment of the cleaning pad secured to a base of the multi-purpose cleaning trowel.

FIG. 7 shows an alternative embodiment of the cleaning trowel 10 with a cleaning pad 146. In this embodiment, the cleaning pad 146 may be removably secured entirely to the second side 38 of the base 12. In one embodiment, the cleaning pad 146 may include a releasable fastener on the attachment side 150 that engages a corresponding releasable fastener on the second side 38 of the base 12. For example, the attachment side 150 of the cleaning pad 146 may include a hook and loop fastener while the second side 38 of the base 12 includes a corresponding hook and loop fastener. Alternatively, the attachment side 150 and second side 38 may include corresponding snap fasteners, for example. It is understood that similar releasable fasteners are considered as well, and the present disclosure is not limited to the examples above.

In the examples above, the trowel 10 may be adapted for use in multiple environments. For example, the trowel may be effectively used in light or dark environments and may be used to treat surfaces that are easily reached by hand with the fixed handle 28, or surfaces that may not be comfortably reached, by switching the fixed handle 28 with the swivel base 128. In addition, the blade section 18 of the trowel 10 allows the trowel 10 to be effectively used in environments where a surface to be cleaned has dried and/or hardened debris adhered thereon. Moreover, the flexible section 16 and blade section 18, together with the first and second attachment loops 54, 56 allow the cleaning pad 46 to be secured on the base 12 in such a way that unintentional removal of the cleaning pad 46 may be reduced or minimized.

It should also be understood that various changes and modifications to the presently disclosed embodiments will be apparent to those skilled in the art. Such changes and modifications can be made without departing from the spirit and scope of the present disclosure and without diminishing its intended advantages. It is therefore intended that such changes and modifications be covered by the appended claims.

The invention claimed is:

1. A cleaning trowel, comprising:

a generally planar base having a first side and a second side, a flexible section extending from a first end of the base, a blade section extending from a second end of the base opposite the first end of the base, and a mounting section positioned between the flexible section and the blade section, the flexible section and the blade section being formed from different materials than each other, wherein the flexible section includes a plurality of generally linear grooves forming areas of reduced thickness to allow for flexing, the generally flexible section between the grooves having a generally uniform thickness, and wherein the blade section has a proximate end and a distal end and decreases in thickness from the proximate end to the distal end;

a handling device on the first side of the base at the mounting section, the handling device being a fixed handle and including a handle base and a gripping portion, wherein the handle base is removably secured to and in contact with the mounting section, and the gripping portion extends from the handle base at an angle such that the gripping portion is spaced from the base, the fixed handle housing a power source; and a cleaning pad receiving region on the base.

2. The cleaning trowel of claim 1, wherein the flexible section is made from a different material than other portions of the base.

3. The cleaning trowel of claim 1, wherein the flexible section is a different color than other portions of the base.

4. The cleaning trowel of claim 1, wherein the blade section is made from the same material as the mounting section and is integrally formed as a one-piece construction with the mounting section.

5. The cleaning trowel of claim 1, wherein the mounting section includes at least one fastening hole configured to receive a fastener to removably secure the handling device to the mounting section.

6. The cleaning trowel of claim 5, wherein the at least one fastening hole extends through the base from the first side to the second side.

7. The cleaning trowel of claim 1, wherein the power source is at least one battery.

8. The cleaning trowel of claim 1, wherein the fixed handle further includes at least one light operably connected to the power source.

9. The cleaning trowel of claim 8, wherein the at least one light includes at least one white light and at least one ultraviolet light.

10. The cleaning trowel of claim 8, wherein the fixed handle further comprises a switch to operate the at least one light.

11. The cleaning trowel of claim 1, wherein the handling device is a swivel base, wherein the swivel base is configured to connect to an elongated handle member.

12. The cleaning trowel of claim 11, wherein the swivel base is rotatable about two axes.

13. The cleaning trowel of claim 1, wherein the handling device is removably secured to the mounting section, and including a swivel base, wherein the swivel base is configured to rotate about two axes and is configured to have an elongated member connected thereto.

14. The cleaning trowel of claim 1 including a cleaning pad mounted to the cleaning pad receiving region.

15. A cleaning trowel, comprising:

a generally planar base having a first side and a second side, a flexible section extending from a first end of the base, a blade section extending from a second end of the base opposite the first end of the base, and a mounting section positioned between the flexible section and the blade section, the flexible section and the blade section being formed from different materials than each other, wherein the flexible section includes a plurality of generally linear grooves forming areas of reduced thickness to allow for flexing, the generally flexible section between the grooves having a generally uniform thickness, and wherein the blade section has a proximate end and a distal end and decreases in thickness from the proximate end to the distal end;

a handling device on the first side of the base at the mounting section; and a cleaning pad, the cleaning pad including a cleaning side configured to engage a surface to be cleaned and an attachment side configured to be attached to the base, the attachment side facing the first side of the base and including a first attachment loop configured to receive the flexible section of the base and a second attachment loop configured to receive the blade section of the base, thereby removably securing the cleaning pad to the base.

16. The cleaning trowel of claim 15, wherein the cleaning side includes a plurality of microfiber loops configured to clean a surface.

* * * * *